US008894393B2

(12) United States Patent
Ju

(10) Patent No.: US 8,894,393 B2
(45) Date of Patent: Nov. 25, 2014

(54) OIL PUMP FOR VEHICLE

(75) Inventor: Yeon Ho Ju, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 220 days.

(21) Appl. No.: 13/551,152

(22) Filed: Jul. 17, 2012

(65) Prior Publication Data

US 2013/0136644 A1 May 30, 2013

(30) Foreign Application Priority Data

Nov. 30, 2011 (KR) ..... 10-2011-0127263

(51) Int. Cl.

| | |
|---|---|
| ***F01C 20/18*** | (2006.01) |
| ***F03C 2/00*** | (2006.01) |
| ***F03C 4/00*** | (2006.01) |
| ***F04C 2/00*** | (2006.01) |
| ***F04C 28/18*** | (2006.01) |

(52) U.S. Cl.

USPC ..... 418/27; 418/25; 418/26; 418/30

(58) Field of Classification Search

CPC ..... F01C 19/00; F01C 19/005; F01C 14/226; F01C 15/003; F01C 15/0034; F01M 2001/0238

USPC ..... 418/179, 16, 55.4, 24–60, 152, 259, 418/266–268, 81–82

See application file for complete search history.

(56) References Cited

U.S. PATENT DOCUMENTS

| | | | | |
|---|---|---|---|---|
| 5,423,579 | A * | 6/1995 | Blose et al. | 285/334 |
| 8,747,085 | B2 * | 6/2014 | Schmidt et al. | 418/29 |
| 2007/0212243 | A1 * | 9/2007 | Yamamuro et al. | 418/30 |
| 2008/0308062 | A1 * | 12/2008 | Morita et al. | 123/196 R |
| 2009/0205827 | A1 * | 8/2009 | Swietlik et al. | 166/285 |
| 2010/0226799 | A1 * | 9/2010 | Watanabe et al. | 417/364 |
| 2010/0266434 | A1 * | 10/2010 | Beez et al. | 418/24 |

FOREIGN PATENT DOCUMENTS

| | | | | |
|---|---|---|---|---|
| JP | 58093978 | A * | 6/1983 | F04C 2/344 |

* cited by examiner

*Primary Examiner* — Thomas Denion
*Assistant Examiner* — Deming Wan
(74) *Attorney, Agent, or Firm* — Morgan, Lewis & Bockius LLP

(57) ABSTRACT

An oil pump for a vehicle including a sealing apparatus is provided for preventing leakage of oil from the regulator chamber. The oil pump includes a sealing chamber formed between the outer ring and the housing, a sealing apparatus disposed in the sealing chamber, and an oil passage formed in the outer ring to facilitate a fluid communication of the sealing chamber with the regulator chamber. The sealing apparatus includes a contact portion, first and second sealing members. The first sealing member closely contacts the contact portion if the second sealing member is pushed by the hydraulic pressure of the regulator chamber supplied thereto through the oil passage, and thus prevents leakage of oil from the regulator chamber.

4 Claims, 2 Drawing Sheets

OIL PUMP FOR VEHICLE

CROSS-REFERENCE TO RELATED APPLICATION

The present application claims priority of Korean Patent Application Number 10-2011-0127263 filed on Nov. 30, 2011, the entire contents of which application is incorporated herein for all purposes by this reference.

BACKGROUND OF INVENTION

1. Field of Invention

The present invention relates to an oil pump for a vehicle. More particularly, the present invention relates to an oil pump for a vehicle in which sealing performance is improved.

2. Description of Related Art

Generally, an oil pump for a vehicle is operated by receiving power from a crankshaft or a camshaft through a chain or a gear, and respectively supplies oil to frictional members of an engine according to suctioning oil from an oil pan and increasing pressure of the oil. Performance of the pump is represented by an amount and pressure of supplied oil. In addition, the oil pump is divided into an external gear type and an internal gear type. In the external gear type, an involute tooth is often used, and in the internal gear type, a trochoid curve is often used.

A regulator is provided at the oil pump so as to maintain hydraulic pressure of a lubrication portion within a predetermined range. In addition, viscosity of oil varies according to the oil temperature, and the amount of supplied oil is increased in proportion to an engine speed. Therefore, the regulator appropriately controls hydraulic pressure for lubricating by temperature. A regulator chamber is provided at the regulator for storing oil, and a sealing apparatus is provided at the regulator for preventing leakage of oil from the regulator chamber.

Meanwhile, performance of the oil pump may be deteriorated if the leakage of oil is generated from the regulator chamber by abrasion of constituent elements of the sealing apparatus.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present application have been made in an effort to provide an oil pump for a vehicle having advantages of improving sealing performance. In other words, the sealing apparatus provided at the oil pump can prevent leakage of oil from the regulator chamber.

An exemplary oil pump for a vehicle according to various aspects of the present application has a housing adapted to form an outer wall of the oil pump, an outer ring adapted to control pumping volume of the oil pump, and a regulator chamber formed between the housing and the outer ring so as to control hydraulic pressure of the oil pump. The oil pump may include a sealing chamber formed between the outer ring and the housing, a sealing apparatus disposed in the sealing chamber for preventing leakage of oil from the regulator chamber, and an oil passage formed in the outer ring to facilitate a fluid communication of the sealing chamber with the regulator chamber. The sealing apparatus may comprise a contact portion disposed on the housing in the sealing chamber, a first sealing member having one end contacting the contact portion, a second sealing member having one end contacting the first sealing member and the other end contacting the outer ring. The first sealing member closely contacts the contact portion if the second sealing member is pushed by the hydraulic pressure of the regulator chamber supplied thereto through the oil passage, and thus prevents leakage of oil from the regulator chamber.

A first slanted surface contacting the second sealing member may be formed at the first sealing member, and a second slanted surface corresponding to the first slanted surface and contacting the first slanted surface may be formed at the second sealing member.

The first slanted surface and the second slanted surface may be configured or slantedly formed such that the first sealing member is pushed toward the contact portion when the second sealing member is pushed by the hydraulic pressure.

The first sealing member may be made of a metallic material or the like. The second sealing member may be made of a metallic material or the like. The contact portion may be made of a rubber material or the like.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
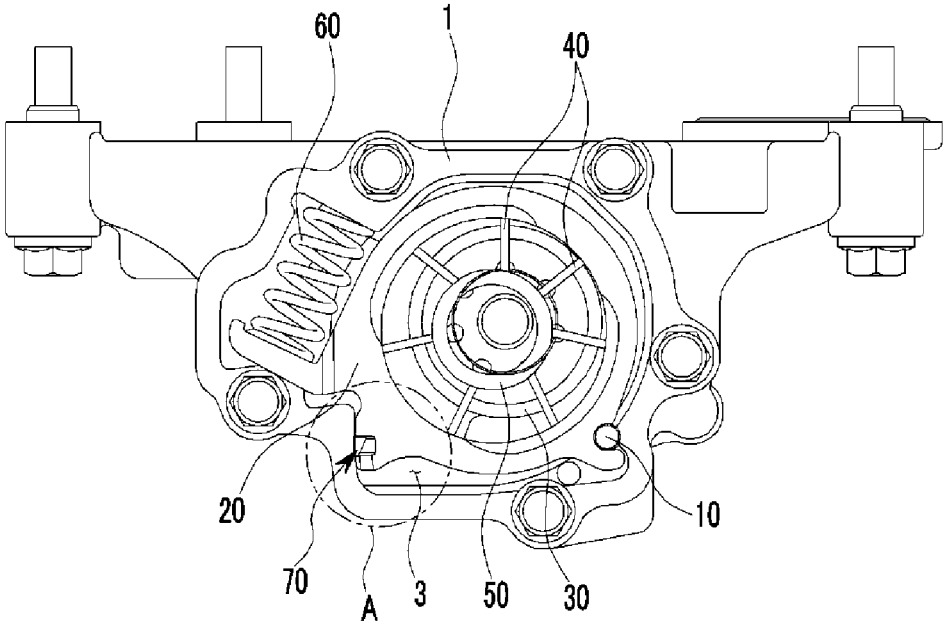
FIG. 1 is a schematic diagram of an exemplary oil pump for a vehicle according to the present application.

FIG. 1 is a schematic diagram of an exemplary oil pump for a vehicle according to various embodiments of the present application. As shown in FIG. 1, an exemplary oil pump for a vehicle includes a housing 1, an outer ring 20, a regulator chamber 3, a rotor 30, a vane 40, an inner ring 50, an elastic member 60, and a sealing apparatus 70.

The housing 1 is a case forming an outer wall of the oil pump.

One end of the outer ring 20 is rotatably connected to the housing 1 by a pivot pin 10. In addition, the outer ring 20 rotates around the pivot pin 10 and controls pumping volume of the oil pump.

The regulator chamber 3 is a space for storing a part of oil supplied from the oil pump. That is, the part of oil supplied from the oil pump flows into the regulator chamber 3. In addition, the regulator chamber 3 is adapted to control hydraulic pressure of the oil pump and is formed between the housing 1 and the outer ring 20.

The rotor 30 rotates and moves in a radial direction when the oil pump is operated by rotation of a crankshaft or a camshaft. Thus, oil is pumped by operation of the rotor 30.

The vane 40 is rotated by rotation of the rotor 30. In addition, the pumping volume may be controlled according to the number of vanes 40.

The inner ring 50 is disposed at the inside of the outer ring 20, and the radius of the inner ring 50 is smaller than the radius of the outer ring 20. In addition, the inner ring 50 contacts one end of the vane 40, and the other end of the vane 40 and the interior circumference of the outer ring 20 constantly contact each other.

The elastic member 60 is disposed at one side of the outer ring 20. The elastic member 60 controls operation pressure for stably maintaining working moment of the outer ring 20.

The sealing apparatus 70 is provided so as to prevent oil from leaking from the regulator chamber 3. In addition, the sealing apparatus 70 is disposed between the exterior circumference of the outer ring 20 and the housing 1 and near the regulator chamber 3.

Meanwhile, the construction of the oil pump is well-known to a person of ordinary skill in the art. Therefore, a detailed description thereof will be omitted.

Figure 2:
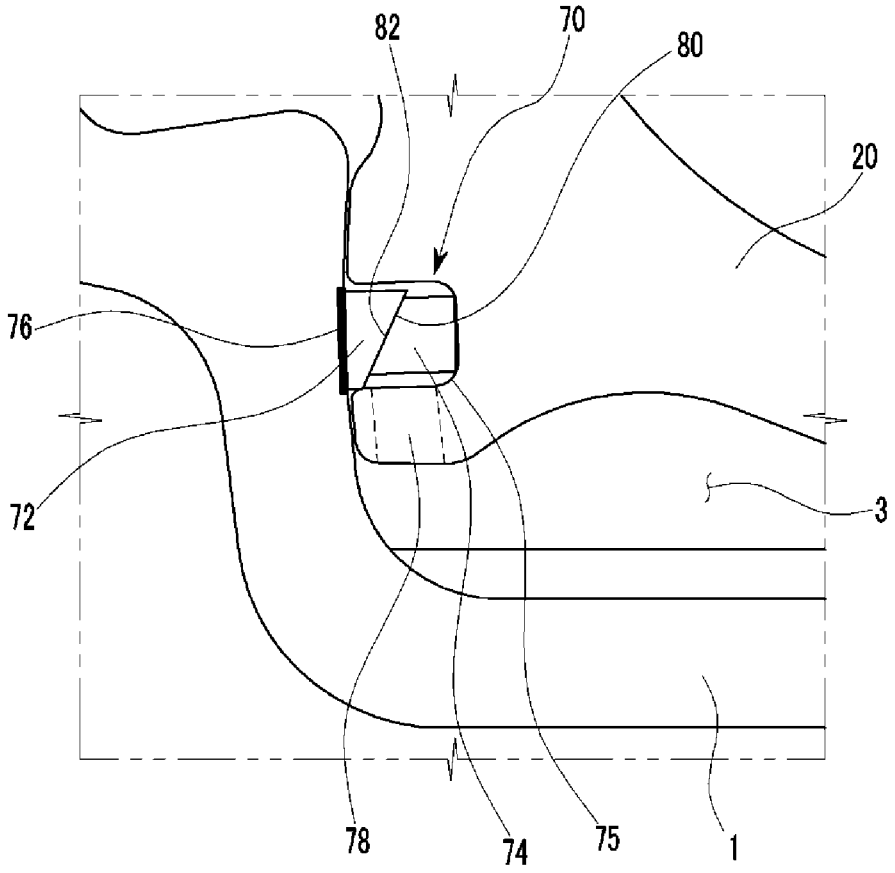
FIG. 2 is an enlarged schematic diagram illustrating the "A" region of the exemplary sealing apparatus shown in FIG. 1.

FIG. 2 is an enlarged schematic diagram showing the "A" region of the sealing apparatus shown in FIG. 1. As shown in FIG. 2, the sealing apparatus 70 according to various embodiments of the present application includes a sealing chamber 75, a contact portion 76, a first sealing member 72, a second sealing member 74 and an oil passage 78. In various embodiments, the sealing apparatus 70 includes a contact portion 76, a first sealing member 72, and a second sealing member 74. The sealing apparatus 70 is disposed in a sealing chamber 75, which is in fluid communication with an oil passage 78.

The sealing chamber 75 is formed between the outer ring 20 and the housing 1. In addition, the sealing chamber 75 is formed in a shape such that a portion of the sealing chamber 75 is fitted on the exterior circumference of the outer ring 20. Further, the constituent elements 72, 74, and 76 of the sealing apparatus 70 are disposed in the sealing chamber 75.

The contact portion 76 is disposed at the housing 1 in the sealing chamber 75. In addition, the contact portion 76 may be integrally and/or monolithically formed with or mounted on the interior surface of the housing 1. Meanwhile, the contact portion 76 may be made of a rubber material or the like such that the sealing apparatus 70 easily performs sealing.

The first sealing member 72 is formed substantially in a shape of a quadrangle. In addition, one end of the first sealing member 72 contacts the contact portion 76, and a first slanted surface 80 is formed at the other end of the first sealing member 72. That is, one of four faces of the first sealing member 72 formed in the shape of quadrangle is slantedly formed. The first sealing member 72 may be made of a metallic material or the like.

The second sealing member 74 is formed substantially in a shape of a quadrangle. In addition, the second sealing member 74 contacts the first sealing member 72 and the outer ring 20. In other words, one end of the second sealing member 74 contacts the first sealing member 72, and the other end of the second sealing member 74 contacts the outer ring 20. A second slanted surface 82 is formed at the one end of the second sealing member 74 and contacts the first slanted surface 80. That is, one of the four faces of the second sealing member 74 formed in the shape of a quadrangle is slantedly formed. The second slanted surface 82 may be formed in a shape corresponding to the first slanted surface 80. The second sealing member 74 may be made of a metallic material or the like.

The oil passage 78 is adapted to facilitate a fluid communication of the sealing chamber 75 with the regulator chamber 3. Hydraulic pressure of the regulator chamber 3 is supplied to the sealing chamber 75 through the oil passage 78. Hydraulic pressure supplied to the sealing chamber 75 pushes the second sealing member 74.

The second sealing member 74 is pushed by the hydraulic pressure supplied to the sealing chamber 75 and moves in one direction. The second slanted surface 82 is configured such that the second sealing member 74 is wider toward the oil passage 78 and narrows gradually along this one direction. Accordingly, the first sealing member 72 is configured to be narrower toward the oil passage 78 and becomes wider gradually along this one direction.

In detail, the first sealing member 72 is pushed toward the contact portion 76 according to the second sealing member 74 that moves in the one direction by hydraulic pressure supplied from the sealing chamber 75. That is, the sealing is performed since the one end of the first sealing member 72 closely contacts the contact portion 76. Therefore, sealing performance is maintained by close contact of the first sealing member 72 and the contact portion 76 even if the contact portion 76 made of the rubber material or the like is worn.

According to various embodiments of the present application, performance of the sealing apparatus 70 is improved by using the sealing members 72 and 74 made of a metallic material or the like. In other words, leakage of oil from the regulator chamber 3 by abrasion of the sealing members 72 and 74 can be prevented. Therefore, performance and reliability of an oil pump for a vehicle can be improved.

For convenience in explanation and accurate definition in the appended claims, the terms "inner" or "outer", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An oil pump for a vehicle having a housing adapted to form an outer wall of the oil pump, an outer ring adapted to control a pumping volume of the oil pump, and a regulator chamber formed between the housing and the outer ring so as to control a hydraulic pressure of the oil pump, the oil pump comprising:

a sealing chamber formed between the outer ring and the housing;

a sealing apparatus disposed in the sealing chamber for preventing leakage of oil from the regulator chamber, the sealing apparatus comprising:

a contact portion disposed on the housing in the sealing chamber, a first sealing member having one end contacting the contact portion, a second sealing member having one end contacting the first sealing member and the other end contacting the outer ring; and an oil passage formed in the outer ring to facilitate a fluid communication of the sealing chamber with the regulator chamber;

wherein the first sealing member closely contacts the contact portion if the second sealing member is pushed by the hydraulic pressure of the regulator chamber supplied thereto through the oil passage;

wherein a first slanted surface contacting the second sealing member is formed at the first sealing member, and a second slanted surface corresponding to the first slanted surface and contacting the first slanted surface is formed at the second sealing member; and wherein the first slanted surface and the second slanted surface are configured such that the first sealing member is pushed toward the contact portion when the second sealing member is pushed by the hydraulic pressure.

2. The oil pump of claim 1, wherein the first sealing member is made of a metallic material.

3. The oil pump of claim 1, wherein the second sealing member is made of a metallic material.

4. The oil pump of claim 1, wherein the contact portion is made of a rubber material.

* * * * *